United States Patent [19]

Newport, Jr. et al.

[11] 4,231,732

[45] Nov. 4, 1980

[54] GAS BURNER CONTROL SYSTEM

[75] Inventors: Harry E. Newport, Jr., Crestwood; Robert L. Baysinger, St. Louis County, both of Mo.

[73] Assignee: Emerson Electric Co., St. Louis, Mo.

[21] Appl. No.: 939,414

[22] Filed: Sep. 5, 1978

[51] Int. Cl.[3] ..... F23Q 9/08

[52] U.S. Cl. ..... 431/46; 431/74

[58] Field of Search ..... 431/6, 43, 45, 59, 46, 431/25, 72, 74

[56] References Cited

U.S. PATENT DOCUMENTS

| | | | |
|---|---|---|---|
| 3,963,410 | 6/1976 | Baysinger | 431/46 |
| 4,086,048 | 4/1978 | Carlson | 431/46 |

*Primary Examiner*—Carroll B. Dority, Jr.

*Assistant Examiner*—Lee E. Barrett

*Attorney, Agent, or Firm*—Paul A. Becker, Sr.

[57] ABSTRACT

Upon a call for heat, gas flows to a pilot burner and a storage capacitor begins to charge. When sufficiently charged, the storage capacitor effects the opening of a valve controlling flow of gas to a main burner disposed in igniting relationship with the pilot burner. A hold-in circuit maintains the main burner valve open once it is opened. Circuit means connected in circuit with the storage capacitor and spark generating circuit means is responsive to the presence of charging current to the storage capacitor for preventing sparking until the storage capacitor is sufficiently charged to effect the pull-in of the main burner valve upon discharge, and is subsequently responsive to the presence of a hold-in current for terminating sparking.

7 Claims, 1 Drawing Figure

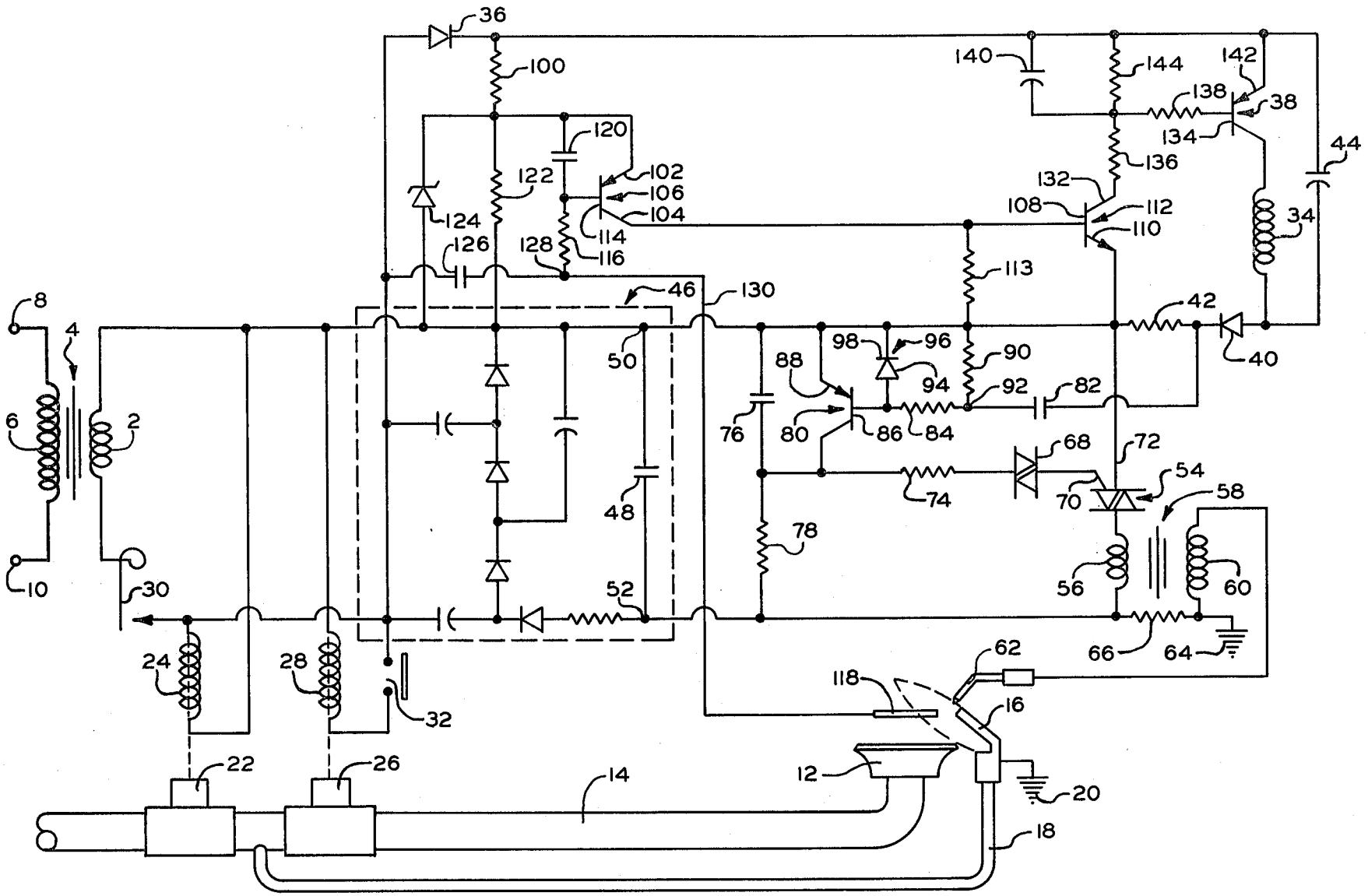
44
34
38
142
138
134
40
42
144
136
112
110
132
108
140
113
90
92
82
68
70
72
54
58
60
64
66
56
20
18
62
16
118
12
96
94
84
86
74
98
88
80
78
76
130
46
102
106
104
120
114
116
128
122
100
36
124
126
50
48
52
14
32
26
28
22
24
30
2
4
6
8
10

GAS BURNER CONTROL SYSTEM

This invention relates to burner control systems for fluid fuel burners and particularly, to burner control systems for domestic gas furnaces wherein, upon a call for heat, a pilot burner flame is established by spark ignition means, and a main burner is subsequently ignited by the pilot burner flame.

The increasing emphasis on conservation of energy has generated a variety of control systems for operating domestic gas furnace burners in a more economical manner. One particularly popular concept is to establish, by spark ignition, a pilot burner flame only when burner operation is required rather than maintain a pilot burner flame at all times. In such systems, the general sequence of operation is: thermostat closes; gas flows to the pilot burner and spark generating circuit means is energized; gas is ignited; existence of pilot burner flame is detected; a valve control circuit responds to flame detection means and allows gas to flow to the main burner; and the main burner is ignited by the pilot burner flame.

A necessary safety requirement of such burner control systems is that main gas be allowed to flow only when a pilot burner flame exists. One approach to meeting this requirement has been to utilize a valve control circuit having a main valve pull-in circuit comprising a winding controlling the main valve, a flame responsive switching means, and a storage capacitor. The storage capacitor is connected in parallel with the flame responsive switching means and the main valve controlling winding so that when the switching means is open, the capacitor can charge. The storage capacitor requires a predetermined time to charge to a sufficient level to enable energizing the main valve controlling winding sufficiently to open the main valve when the switching means is subsequently closed and the capacitor discharges through the main valve controlling winding. Thus, any failure in the system, resulting in a false indication of the existence of a pilot burner flame, prevents the flow of gas to the main burner. Such a valve control circuit is shown in U.S. Pat. No. 3,963,410, issued on June 15, 1976, to Robert L. Baysinger, and assigned to the assignee of the present invention.

The system in the aforementioned patent also includes spark generating circuit means including storage capacitors which also require predetermined times to charge to the values necessary to effect sparking at the pilot burner. While safety requirements necessitate some delay in charging the storage capacitor in the valve control circuit, it is necessary, to prevent nuisance shut-downs, that the storage capacitor in the valve control circuit be sufficiently charged when the storage capacitors in the spark generating circuit means effect sparking. Thus, values of the components in the storage capacitor circuits of the spark generating circuit means and the valve control circuit are quite critical.

An object of the invention is to provide an improved gas burner control system having a pilot burner energized only upon a call for heat and a main burner ignited by the pilot burner flame, wherein a valve control circuit for controlling gas flow to the main burner includes a storage capacitor, and wherein spark generating circuit means for effecting ignition of gas at the pilot burner is rendered ineffective until the storage capacitor is sufficiently charged.

A further object is to provide such a control system having circuit means connected in circuit with the valve control circuit and the spark generating circuit means for delaying generation of sparks until the valve control circuit is rendered capable of allowing gas to flow to the main burner.

A further object is to provide such a control system which is safe, reliable, and economical to produce.

Further objects and advantages will appear from the following description when read in connection with the accompanying drawing.

The single FIGURE of the drawing is a schematic illustration of a gas burner control system constructed in accordance with the invention.

DESCRIPTION OF THE PREFERRED EMBODIMENT

Referring to the single FIGURE of the drawing, the gas burner control system is adapted to be energized by the secondary winding 2 of a voltage step-down transformer 4 which has its primary winding 6 connected across terminals 8 and 10 of a conventional 120 volt alternating current power source.

A main burner 12 is supplied with gas from a gas source through a conduit 14. Mounted adjacent main burner 12 is a pilot burner 16 connected by a conduit 18 to conduit 14. Pilot burner 16 is constructed of electrically conductive material and is grounded at 20.

A first electromagnetically operated valve 22 having a winding 24 and a second electromagnetically operated valve 26 having a winding 28 are interposed in series flow relationship in conduit 14. Conduit 18 leading to pilot burner 16 is connected to conduit 14 between valves 22 and 26. When valve 22 is open, gas flows only to pilot burner 16; when both valves 22 and 26 are open, gas also flows to main burner 12. When valves 22 and 26 are shown as separate valves, it is to be understood that they can be combined into a single device.

Winding 24 of valve 22 is connected across transformer secondary winding 2 through a thermostat 30. Winding 28 of valve 26 is connected across secondary winding 2 through thermostat 30 and through normally open contacts 32 of an electromagnetically operated relay having a winding 34.

Winding 34 is connected across transformer secondary winding 2 through thermostat 30, a diode 36, a PNP transistor 38, a diode 40, and a resistor 42. A storage capacitor 44 is connected in parallel with transistor 38 and relay winding 34.

During the half cycles when diodes 36 and 40 are conducting and with transistor 38 off, capacitor 44 is charged through diodes 36 and 40 and resistor 42. During alternate half cycles, diodes 36 and 40 are non-conductive and prevent capacitor 44 from discharging. When transistor 38 is rendered conductive, capacitor 44 discharges through relay winding 34 and causes relay contacts 32 to close, which allows winding 28 to be energized, opening main gas valve 26. Relay winding 34 is then held in through resistor 42 when diodes 36 and 40 are conducting, and by the filtering action of capacitor 44 when diodes 36 and 40 are not conducting. The amount of current flow through relay winding 34 is reduced but is sufficient to keep relay contacts 32 closed. However, discharging of capacitor 44, after being sufficiently charged is required to effect the initial closing of relay contacts 32.

Connected across transformer secondary winding 2 through thermostat 30 is a conventional voltage quadrupler indicated generally at 46. Quadrupler 46 is effective, after a few cycles of the applied alternating current power source, to produce a voltage potential of approximately 130 volts across its capacitor 48, with a point 50 on one side of capacitor 48 being positive with respect to a point 52 on the other side thereof.

Connected across points 50 and 52 is a spark generating circuit including a series connected triac 54 and the primary winding 56 of a voltage step-up transformer 58. The secondary winding 60 of transformer 58 is connected at one end to a spark electrode 62 located in close proximity to pilot burner 16, and connected at its other end to ground at a point 64 and through a resistor 66 to point 52.

A gating circuit for triac 54 includes a diac 68, a voltage breakdown device, connected between gate 70 and a main terminal 72 of triac 54 through a resistor 74 and a capacitor 76. Capacitor 76 is connected in series with a resistor 78 across points 50 and 52 and is effective, when sufficiently charged, to effect conduction of diac 68. With diac 68 turned on, triac 54 conducts, allowing capacitor 48 in voltage quadrupler 46 to discharge through primary winding 56 of transformer 58. A high voltage is induced in secondary winding 60 of transformer 58 causing sparks to be generated between spark electrode 62 and pilot burner 16.

Connected in parallel with capacitor 76 is a PNP transistor 80. A capacitor 82 is connected through a resistor 84 to the base 86 of transistor 80 and through resistor 42 to the emitter 88 of transistor 80. A resistor 90 is connected between emitter 88 of transistor 80 and a point 92 between capacitor 82 and resistor 84. The anode 94 of a diode 96 is connected to the base 86 of transistor 80 and the cathode 98 of diode 96 is connected to the emitter 88 of transistor 80. Diode 96 limits the reverse biasing applied to transistor 80.

As previously described, current flows through resistor 42 when storage capacitor 44 in the valve control circuit is charging, and also when relay winding 34 is subsequently energized with a hold-in current sufficient to keep relay contacts 32 closed. Because of diodes 36 and 40, both the charging current and the hold-in current are rectified half wave currents. Each of these rectified half wave currents causes capacitor 82 to alternately charge and discharge. When capacitor 82 charges, transistor 80 is biased off, allowing capacitor 76 to charge through its charge resistor 78. When capacitor 82 discharges, it biases transistor 80 on. With transistor 80 on, capacitor 76 is prevented from charging and begins to discharge through transistor 80. Under these conditions, capacitor 76 is prevented from being charged to the firing voltage of diac 68.

When storage capacitor 44 is sufficiently charged, diodes 36 and 40 no longer conduct, and current ceases to flow to capacitor 82. Transistor 80 can no longer be biased on, and capacitor 76 charges to the firing voltage of diac 68.

Also connected across secondary winding 2 of transformer 4, in series, are thermostat 30, diode 36, a resistor 100, the emitter 102 and collector 104 of a PNP darlington transistor 106, and the base 108 and emitter 110 of an NPN transistor 112. A bias resistor 113 is connected between the base 108 and emitter 110 of transistor 112. The base 114 of transistor 106 is connected through a high impedance resistor 116 to a sensing probe 118 located adjacent pilot burner 16 so as to be impinged by the pilot burner flame. A filter capacitor 120 is connected in parallel with the emitter 102 and base 114 of transistor 106.

A reference voltage for transistor 106 is established by a resistor 122 and a zener diode 124 connected in parallel between the emitter 102 of transistor 106 and point 50.

A capacitor 126 is connected between the anode of diode 36 and a point 128 between resistor 116 and a lead 130 connected to sensing probe 118. Capacitor 126 compensates for any induced voltage on lead 130 which would tend to turn on transistor 106 or at least keep it on once it was conducting.

In the absence of a pilot burner flame, the impedance between sensing probe 118 and pilot burner 16 is extremely high so that transistor 106 is biased off. When a pilot burner flames appears, the impedance between sensing probe 118 and pilot burner 16, through the flame, decreases, enabling transistor 106 to be biased on so that it conducts each half cycle that diode 36 conducts. When transistor 106 conducts, transistor 112 is also biased on.

The collector 132 of transistor 112 is connected to the base 134 of transistor 38 in the valve control circuit through current limiting resistor 136 and 138. When transistor 112 is on, transistor 38 is biased on through resistors 136 and 138 and transistor 112. To maintain conduction of transistor 38 during the half cycle that diode 36 is non-conductive, a capacitor 140 is connected between the emitter 142 and base 134 of transistor 38 through resistor 138. With this arrangement, during the half cycle that diode 36 is conducting, capacitor 140 charges through resistor 136 and transistor 112. During the half cycle that diode 36 is not conductive, capacitor 140 discharges through the emitter 142 and base 134 of transistor 38 through resistor 138, thus keeping transistor 38 on. A bleed resistor 144 is connected across capacitor 140 to allow complete discharge of capacitor 140 when diode 36 remains non-conductive.

OPERATION

When thermostat 30 closes its contacts, winding 24 is energized, causing valve 22 to open which allows gas to flow through conduit 18 to pilot 16. Concurrently, voltage quadrupler 46 is energized and, after a few cycles of applied alternating current from transformer secondary winding 2, capacitor 48 in voltage quadrupler 46 is charged to approximately 130 volts.

The extremely high impedance between sensing probe 118 and pilot burner 16, in the absence of a flame, prevents biasing of transistor 106. With transistor 106 off, transistors 112 and 38 are also off. With transistor 38 off, storage capacitor 44 in the valve control circuit begins to charge through diodes 36 and 40 and resistor 42. Because of diodes 36 and 40, the current is rectified half wave current.

When current flows through resistor 42, current also flows to capacitor 82. Since the current to capacitor 82 is also rectified half wave, capacitor 82 alternately charges and discharges, causing transistor 80 to alternately turn off and on, respectively, which prevents capacitor 76 in the gate circuit of triac 54 from charging to the firing voltage of diac 68.

After a number of cycles of the rectified half wave current, storage capacitor 44 is essentially fully charged and diode 36 blocks further current flow to capacitor 44. The resulting cessation of current flow through resistor 42 and to capacitor 82 prevents transistor 80 from being periodically biased on. Transistor 80 being off enables capacitor 76 to be charged to the firing voltage of diac 68. When diac 68 fires, triac 54 is gated on, enabling capacitor 48 in voltage quadrupler 46 to discharge through triac 54 and the primary winding 56 of the spark transformer 58. A high voltage is induced in the secondary winding 60, producing sparks between spark electrode 62 and pilot burner 16 for igniting the pilot burner gas.

When a pilot burner flame appears, the reduced impedance path through the flame enables transistor 106 to be biased on. Transistor 106 being on enables transistor 112 to become conductive, which in turn, enables transistors 38 to also become conductive. When transistor 38 becomes conductive, storage capacitor 44 discharges through transistor 38 and relay winding 34, causing relay contacts 32 to close. With relay contacts 32 closed, valve winding 28 is energized, causing valve 26 to open. Gas then flows through conduit 14 to main burner 12, and the main burner gas is ignited by the pilot burner flame.

After relay contacts 32 have been closed by the discharge of capacitor 44 through relay winding 34, winding 34 is subsequently energized at a lower power level sufficient to maintain relay contacts 32 closed but insufficient to initially close them. A "hold-in" circuit for winding 34 is provided through resistor 42 during the half cycles when diodes 36 and 40 are conducting, and by capacitor 44 during the alternate half cycles when diodes 36 and 40 are not conducting. Thus, the current flow through resistor 42 and to capacitor 82, under this condition, is again rectified half wave. As was previously described, transistor 38 is maintained conductive by capacitor 140 during the half cycles when diodes 36 and 40 are not conducting.

The half wave rectified hold-in current flow through resistor 42 and to capacitor 82 is effective to prevent capacitor 76 from charging to the firing voltage of diac 68, so that the spark generating circuit means is again rendered ineffective to produce sparking.

While the invention has been illustrated and described in detail in the drawing and foregoing description, it will be recognized that many changes and modifications will occur to those skilled in the art. It is therefore intended, by the appended claims, to cover any such changes and modifications as fall within the true spirit and scope of the invention.

We claim;

1. In a gas burner control system wherein a main burner is ignited by a pilot burner, wherein spark generating circuit means is operative to ignite the pilot burner upon a call for heat and gas flow to the main burner is prevented until a pilot burner flame exists, and wherein a storage capacitor, when sufficiently charged, is opertive upon discharge thereof to effect gas flow to the main burner, the improvement comprising circuit means connected in circuit with the storage capacitor and the spark generating circuit means responsive to charging current of said storage capacitor for delaying energization of said spark generating circuit means until said storage capacitor is sufficiently charged.

2. The control system claimed in claim 1 wherein said charging current is rectified half wave current which flows through said circuit means connected in circuit with said storage capacitor and said spark generating circuit means when said storage capacitor is charging and which ceases to flow therethrough when said storage capacitor is essentially fully charged, and wherein said spark generating circuit means includes switching means which, when conducting, enables generation of sparks, and gate circuit means for controlling conduction of said switching means, said circuit means connected in circuit with said storage capacitor and said spark generating circuit means being responsive to said flow of said rectified half wave current therethrough for preventing said gate circuit means from effecting conduction of said switching means and being responsive to said cessation of said rectified half wave current flow therethrough for enabling said gate circuit means to effect conduction of said switching means.

3. The control system claimed in claim 2 wherein said gate circuit means includes a capacitor and a voltage breakdown device, saaid circuit means connected in circuit with said storage capacitor and said spark generating circuit means including a transistor having its emitter- collector circuit connected in parallel with said capacitor in said gate circuit means so that said capacitor in said gate circuit means can charge only when said transistor is off, and a capacitor and a resistor connected in series with the base-emitter circuit of said transistor, said capacitor in series with said base-emitter circuit alternately charging during the half cycles when said rectified half wave current flows and discharging during the half cycles when said rectified half wave current does not flow, said discharging being through said base-emitter circuit and said resistor and effective to cause said transistor to conduct thereby preventing said capacitor in said gate circuit means from attaining a voltage sufficient to effect conduction of said voltage breakdown device until said rectified half wave current ceases, said cessation preventing said transistor from being biased on and thus enabling said capacitor in said gate circuit means to attain said sufficient voltage to effect conduction of said voltage breakdown device.

4. The control system claimed in claim 3 further including a diode connected in parallel with and in reverse polarity to said base emitter circuit of said transistor for limiting a reverse bias applied to said transistor when said capacitor in series with said base-emitter circuit is charging.

5. In a gas burner control system, a pilot burner;

a main burner disposed to be ignited by said pilot burner;

a first valve controlling the flow of gas to said pilot burner and to said main burner;

a second valve fluidically in series with said first valve and controlling the flow of gas to said main burner;

electrically operated means for controlling operation of said first valve including a first winding adapted to be energized upon a call for heat to allow gas to flow to said pilot burner;

electrically operated means for controlling operation of said second valve including a second winding;

a source of electrical power;

circuit means including rectifier means for providing a rectified half wave current flow, a first controlled solid state switching means, and a resistor connected in series with each other and with said second winding and connecting said second winding to said power source;

a storage capacitor connected in parallel with said series-connected first switching means and second winding, and in series with said rectifier means and said resistor;

said storage capacitor being charged through said rectifier means and said resistor, when said first switching means is not conducting, by a rectifier half wave charging current flow, said charging current flow being blocked by said rectifier means when said storage capacitor is essentially fully charged;

said storage capacitor being operative, when essentially fully charged and when said first switching means is initially rendered conductive, for discharging through said second winding and said first switching means and sufficiently energizing said second winding to effect opening of said second valve;

said rectifier means, said resistor, and said storage capacitor being operative, after said storage capacitor has discharged and when said first switching means is conducting, to limit energization of said second winding to a power level sufficient to maintain said second valve open but insufficient to effect opening thereof;

said resistor, after said storage capacitor has discharged and when said first switching means is conducting, being subsequently energized by a rectified half wave current flow therethrough;

spark generating circuit means for igniting said pilot burner;

means responsive to pilot burner flame operative to effect conduction of said first switching means; and circuit means connected in circuit with said spark generating circuit means and said resistor responsive to the presence of said rectified half wave charging current flow through said resistor when said storage capacitor is charging for rendering said spark generating circuit means ineffective, responsive to the absence of said rectified half wave charging current flow through said resistor when said storage capacitor is essentially fully charged for rendering said spark generating circuit means effective, and responsive to the subsequent presence of said rectified half wave current which flows through said resistor after said storage capacitor has discharged and when said first switching means is conducting for rendering said spark generating circuit means ineffective.

6. The control system claimed in claim 5 wherein said spark generating circuit means includes a voltage quadrupler power source, a voltage step-up transformer, a second controlled solid state switching means for controlling energizing of said step-up transformer by said voltage quadrupler power source, and gate circuit means for controlling conduction of said second switching means, the energization of said gate circuit means being controlled by said circuit means connected in circuit with said spark generating circuit means and said resistor.

7. The control system claimed in claim 6 wherein said second switching means is a triac.

* * * * *